350-96.15 SR
7/24/84 XR 4,461,974

United States Patent [19]

Chiu

[11] Patent Number: 4,461,974

[45] Date of Patent: Jul. 24, 1984

[54] DUAL LIGHT SOURCE

[76] Inventor: David Chiu, 50-47 207th St., Bayside, N.Y. 11364

[21] Appl. No.: 386,736

[22] Filed: Jun. 9, 1982

[51] Int. Cl.[3] ..... H05B 39/10

[52] U.S. Cl. ..... 315/65; 315/88; 315/93; 250/551; 350/96.15; 362/12; 362/20

[58] Field of Search ..... 250/551; 362/20, 12; 315/93, 65; 350/96 C

[56] References Cited

U.S. PATENT DOCUMENTS

| | | | |
|---|---|---|---|
| 2,735,928 | 2/1956 | Smethurst | 362/20 |
| 3,327,162 | 6/1967 | Wright | 315/65 |
| 3,541,341 | 11/1970 | Leete | 250/551 |
| 4,048,486 | 9/1977 | Kriege | 362/32 |
| 4,399,358 | 8/1983 | Burkhardt | 315/88 |

OTHER PUBLICATIONS

"Coupling Light-Sources to Fibers," by Mark L. Dakss, Laser Focus, Dec. 1975, pp. 31–34.

"Speroid Lens at Fiber End" by O. R. Gupta, IBM Tech. Disc. Bull., vol. 24, No. 2, Jul. 1981, pp. 1161, 1162.

*Primary Examiner*—Harold Dixon

*Attorney, Agent, or Firm*—Leonard Belkin

[57] ABSTRACT

A multiple lamp system for use with fiber optic light guide for automatically switching from a main lamp to a standby lamp upon failure of the former. A solenoid is employed with the inductor in the circuit of the main lamp to overcome the bias of the switch in the standby lamp circuit to keep the former open. When the main lamp fails causing interruption of current flow, the switch closes thereby permitting energization of the standby lamp. An indicator is provided to show which lamp is functioning.

5 Claims, 1 Drawing Figure

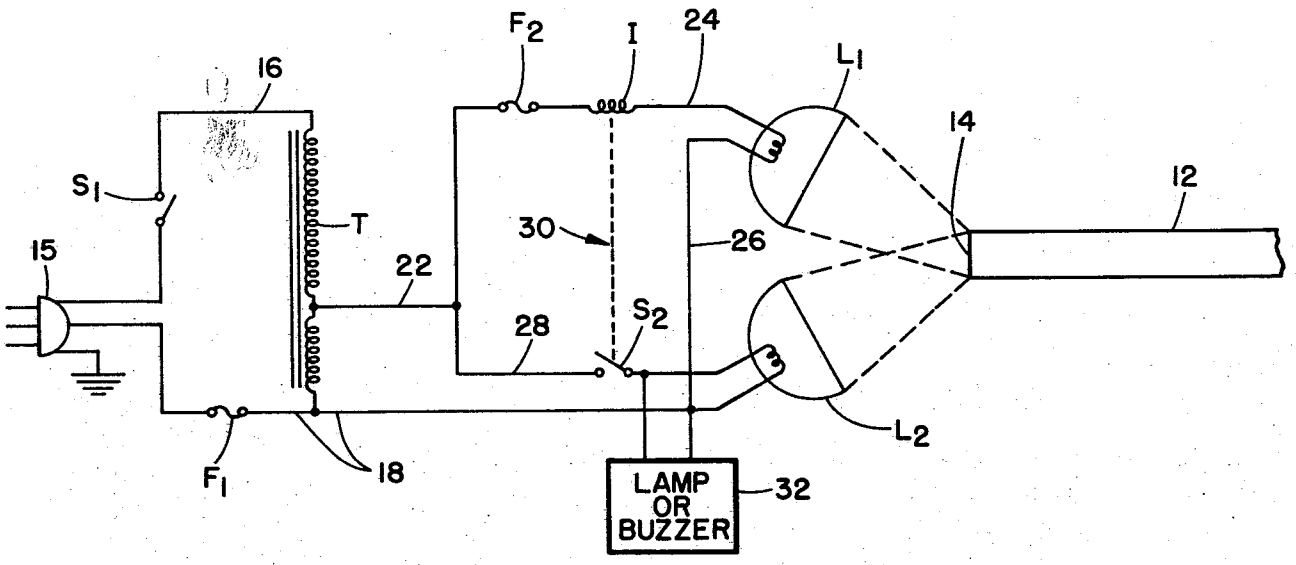
12
14
L1
L2
24
26
32
LAMP OR BUZZER
I
S2
F2
30
28
22
T
18
16
F1
S1
15

DUAL LIGHT SOURCE

BACKGROUND OF THE INVENTION

This invention relates to a dual light source, and more particularly to a system for automatically switching lamps in a fiber optic delivery system when the lamp being used fails in service.

Fiber optic systems for the delivery of light from a source into otherwise inaccessible locations have won widespread acceptance in a variety of situations, including their application to medical technology.

As the lamps which are utilized as the sources of light in fiber optic systems have finite lifetimes, it is readily apparent that the failure of a lamp while in service is most likely to occur during the course of a medical procedure which could be diagnostic or surgical.

In any such situation, lamp failure at best is an inconvenience, while at the other extreme such a failure at a critical point in the procedure could be dangerous to the patient.

A variety of attempts have been made to deal with this problem.

In U.S. Pat. No. 2,735,928, there is provided an emergency standby lamp which is relay activated upon failure of the filament in the primary lamp. This system could not be made applicable to a fiber optic system because there is no provision for angling the light into the end of a fiber optic termination or any other means of directing transmitted light in a specific manner.

In U.S. Pat. Nos. 3,360,640 and 3,437,803, there are disclosed surgical illuminating apparatus in which light failure is accommodated by providing multiple light sources each with its own fiber optic bundles. It is not clear nor shown how any switchover in case of bulb failure would occur.

In U.S. Pat. Nos. 3,577,173 and 4,061,911 are disclosed lamp changing mechanisms for a projector in the event of bulb failure. The standby lamp is physically moved to replace the failed lamp, and such an arrangement would inherently permit a period in which there is a loss of light, also, a mechanical arrangement is likely to be unreliable and possibly awkward in use.

In U.S. Pat. No. 4,048,486, there is provided a dual light system fed into a split fiber optic cable. With both bulbs in use, the failure of a bulb will result in light output being halved. If one lamp were being used with an automatic switchover, the beam splitter would require precision difficult to maintain to split the light exactly in half.

SUMMARY OF THE INVENTION

In the present invention, the problems and drawbacks of existing systems for switching light bulbs in fiber optic light delivery systems are overcome by providing a simple system of optically combining two light sources into one fiber optic bundle, one of which is standby while the other is operating. In the event of failure of the primary source, automatic switching takes place so that there is no significant interruption in light.

In a preferred embodiment of this invention, there is provided a fiber optic light guide with an entrance for light, a pair of lamps directing the light into the entrance of the guide, both within the angle of acceptance of the guide, and an electrical circuit for delivering current to the lamps to effect this operation. Although both lamps are identical, one is the main lamp, and the other is a standby lamp which becomes energized upon the failure of the main lamp. This is accomplished by connecting the lamps in parallel within said electrical circuit.

A solenoid is provided in which the coil is located within the main lamp part of the circuit, while the solenoid actuated switch is in the standby lamp part of the circuit. The switch is biased into its closed position and held open by energization of the solenoid coil. Thus, when the main lamp is functioning properly, the coil is energized and its switch is held open, so that the standby lamp is dark. In the event of failure of the main lamp causing interruption of current flow, the solenoid is deenergized, the switch closes, and the standby lamp becomes energized and begins to direct light into the entrance to the light guide. This switchover is accomplished rapidly with barely any detectable interruption of light.

It is hence a principal object of this invention to provide an illuminating system for a fiber optic light guide with improved reliability.

A further object of this invention is to provide a dual lamp illuminating system for use with a fiber optic light guide capable of switching from one lamp to another efficiently and reliably in the event of failure of the operating lamp.

Other objects and advantages of this invention will hereinafter become obvious from the following detailed description of a preferred embodiment of this invention.

BRIEF DESCRIPTION OF THE DRAWING

The FIGURE illustrates schematically a preferred embodiment of this invention.

DESCRIPTION OF THE PREFERRED EMBODIMENT

Referring to the FIGURE, there is shown a light guide 12 which has an entrance 14 for light. Typically guide 12 would be a fiber optic cable consisting of a bundle of glass filaments as is currently well known in the art. A fiber optic cable has an angle of acceptance in which it can accept the light for transmittal efficiently and effectively. A typical such angle of acceptance is 60 degrees.

A pair of lamps L1 and L2, main and standby, respectively, are mounted as illustrated to focus and direct their light at entrance 14 of cable 12 within the angle of acceptance of the cable entrance. Lamps L1 and L2 illustrated are filament type but, of course, any other variety of electrically powered lamps may be employed.

A source of electrical energy of energize lamps L1 and L2 is provided by way of a connector plug 15, electrical conductors 16 and 18, and a transformer T. In the primary circuit of the latter are provided an on-off switch S1 and a fuse or circuit breaker F1.

A tap from transformer T by conductor 22 and conductor 18 deliver the electric supply to lamps L1 and L2 which are connected in parallel. It will be seen that main lamp L1 is supplied by conductors 24 and 26 while standby lamp L2 is supplied by conductors 18 and 28.

A solenoid 30 consisting of an inductor or coil I, and a switch S2 rendered operative by coil I is provided with coil I in conductor 24 to lamp L1 and switch S2 in conductor 28 to lamp L2. Switch S2 is biased in its closed position but is held open by coil I when the latter is energized.

An indicator 32, which could be a lamp or a buzzer, is connected across conductors 18 and 28.

In conductor 24 is also provided a fuse or circuit breaker F2.

In the operation of the system just described, when plug 15 is connected to an appropriate source of electrical power, on-off switch S1 is closed, main lamp L1 is operable, solenoid coil I is energized, and switch S2 in held open. Thus standby lamp L2 is not operable, and indicator 28 is not receiving any current and therefore gives off no signal of any kind.

When main lamp L1 fails causing termination of current flow, as by an open in its filament, coil I becomes deenergized, switch S2 closes, and standby lamp L2 becomes operable, giving off light to cable 12, replacing that of main lamp L1. In the event of a short circuit, such as within the filament of lamp L1, fuse F2 will open the current, effectively also cutting off current flow.

The closing of switch S2 will also cause indicator 28 to operate, and the signal it emits, such as a lighted lamp or a buzz, will indicate that main lamp L1 has failed. A feature of this invention is that failed lamp L1 can be changed without interrupting light delivered to cable 12, at the same time returning lamp L2 to its standby service.

Another advantage of this invention results from angling the light into the entrance of the fiber optic cable. If light from a conventional quartz halogen lamp is fed on axis, a dark shadow appears at the output of the cable. This is caused by the image of the filament. By angling the light, the filament image is diffused and does not appear at the cable output.

An important feature of this invention is that failure of the main lamp, regardless whether due to an open filament or a short circuit, will automatically bring the standby lamp into operation.

It is thus seen that there has been provided a relatively simple yet reliable arrangement for combining two light sources into one fiber optic bundle, one light source acting as the main lamp and the other source functioning as a standby, plus provision to switch from the main lamp to the standby when the former fails without any significant interruption in light.

While only a preferred embodiment of the invention has been described, it is understood that many variations thereof are possible without departing from the principles of this invention.

What is claimed is:

1. Apparatus for illuminating a light guide system comprising:

a. a light guide having a single entrance transverse to the axis thereof for receiving a beam of light;

b. first and second lamp means having filaments, each lamp means disposed off the axis of said light guide to direct its beam of light at an angle into said entrance within the angle of acceptance of said guide;

c. means for supplying electric current to energize said first and second lamp means comprising a source of said electric current and first and second circuits connecting said first and second lamp means, respectively, in parallel with each other; and d. solenoid means having an energizable coil means in said first circuit and normally closed switch means in said second circuit actuated by said coil means so that when said first lamp means is energized, said coil means is energized causing said switch means to be electrically open so that said second lamp means remains unenergized, whereby failure of said first lamp means resulting in an open in said first circuit will cause said coil means to be deenergized and said switch means to close, thereby causing energization of said second lamp means and the continuation of light directed into said light guide entrance.

2. The apparatus of claim 1 having means to indicate which of said lamp means is functioning.

3. The apparatus of claim 2 having a conductor common to said first and second circuits, said indicator means including an electric circuit between said common conductor and said second circuit between said switch means and said second lamp means.

4. The apparatus of claim 3 in which said light guide is a fiber optic cable.

5. The apparatus of claim 1 having means in said first circuit for opening the latter in the event of current overload.

* * * * *